US008109221B2

(12) United States Patent
Graf et al.

(10) Patent No.: US 8,109,221 B2
(45) Date of Patent: Feb. 7, 2012

(54) SINGLE DRIVE CATAMARAN HULL

(75) Inventors: Lawrence J Graf, Snohomish, WA (US); David J. Pugh, Snohomish, WA (US)

(73) Assignee: Aspen Power Catamarans LLC, Snohomish, WA (US)

( * ) Notice: Subject to any disclaimer, the term of this patent is extended or adjusted under 35 U.S.C. 154(b) by 0 days.

(21) Appl. No.: 12/195,093

(22) Filed: Aug. 20, 2008

(65) Prior Publication Data

US 2010/0043688 A1 Feb. 25, 2010

(51) Int. Cl.
*B63B 1/00* (2006.01)

(52) U.S. Cl. ..... 114/61.2

(58) Field of Classification Search ..... 114/61.1–61.19, 114/61.2–61.29, 61.3–61.33, 62, 63
See application file for complete search history.

(56) References Cited

U.S. PATENT DOCUMENTS

| | | | | | |
|---|---|---|---|---|---|
| 2,464,957 | A | | 2/1945 | Wood | |
| 2,756,711 | A | * | 7/1956 | Simpson | 114/39.24 |
| 3,173,395 | A | * | 3/1965 | Laurent | 114/39.26 |
| 3,223,065 | A | * | 12/1965 | Wilson, Jr. | 114/39.26 |
| 3,304,899 | A | * | 2/1967 | Weatherly | 114/39.25 |
| 3,747,549 | A | * | 7/1973 | Shutt | 114/280 |
| 3,870,004 | A | * | 3/1975 | Bailey | 114/39.28 |
| 4,224,889 | A | | 9/1980 | Spiegel | |
| 5,188,049 | A | | 2/1993 | Graf | |
| 5,191,848 | A | | 3/1993 | Hatfield | |
| 5,231,949 | A | | 8/1993 | Hadley | |
| 5,379,710 | A | | 1/1995 | Parnigoni | |
| 5,522,333 | A | | 6/1996 | Lang et al. | |
| 5,570,650 | A | | 11/1996 | Harley | |
| 5,724,905 | A | * | 3/1998 | Pizzey | 114/39.14 |
| 6,202,582 | B1 | * | 3/2001 | Risley | 114/102.33 |
| 6,345,582 | B1 | * | 2/2002 | Dudink | 114/61.15 |
| 6,345,584 | B1 | | 2/2002 | Mascellaro | |
| 7,143,710 | B2 | | 12/2006 | Lang et al. | |

* cited by examiner

*Primary Examiner* — Daniel Venne
(74) *Attorney, Agent, or Firm* — Clark A. Puntigam; Jensen & Puntigam, P.S.

(57) ABSTRACT

The catamaran hull includes a pair of substantially parallel separate hulls, connected by an intermediate hull portion, wherein only one of the separate hulls includes a propulsion assembly. Each hull is asymmetric, but differently configured, such that the off-center thrust created by the propulsion assembly in the one hull is substantially offset by the turning force created by the difference in the two asymmetric hull shapes.

9 Claims, 5 Drawing Sheets

SINGLE DRIVE CATAMARAN HULL

TECHNICAL FIELD

This invention relates generally to catamaran hull construction, and more specifically concerns such a hull having two different asymmetrical hull shapes.

BACKGROUND

Catamarans typically have two identical, usually asymmetric, hulls which are mirror images of each other. Any turning force induced by one hull is thus offset by the turning force from the other hull. Catamaran hulls often are quite narrow and hence have disadvantages in terms of space and efficiency. Wide catamaran hulls have more interior space but create larger wakes which result in greater drag. In addition, catamaran hulls usually require propeller pockets configured to reduce propeller shaft angle. Conventional propeller pockets result in the water in the pockets being forced to change direction in a relatively short space, which in turn increases drag on the boat; narrow hulls in general distort the water flow less than wide hulls, thereby producing less drag. Energy loss can also be significant due to wake generation.

Accordingly, it is an object of the present invention to produce a catamaran hull arrangement which improves efficiency by reducing drag, and further to increase usable space within a given hull size.

SUMMARY

Accordingly, a catamaran hull is disclosed, comprising: a pair of substantially parallel separate hulls connected by an intermediate hull portion, wherein each separate hull has a shape which is asymmetric; and a propulsion assembly positioned in only one of the separate hulls, defining a propulsion hull, wherein the two separate hulls have different asymmetric configurations such that the off-center thrust created by action of the propulsion assembly in the one hull is substantially offset by the turning force created by the difference in shape of the two separate hulls.

BEST MODE FOR CARRYING OUT THE INVENTION

Figure 1:
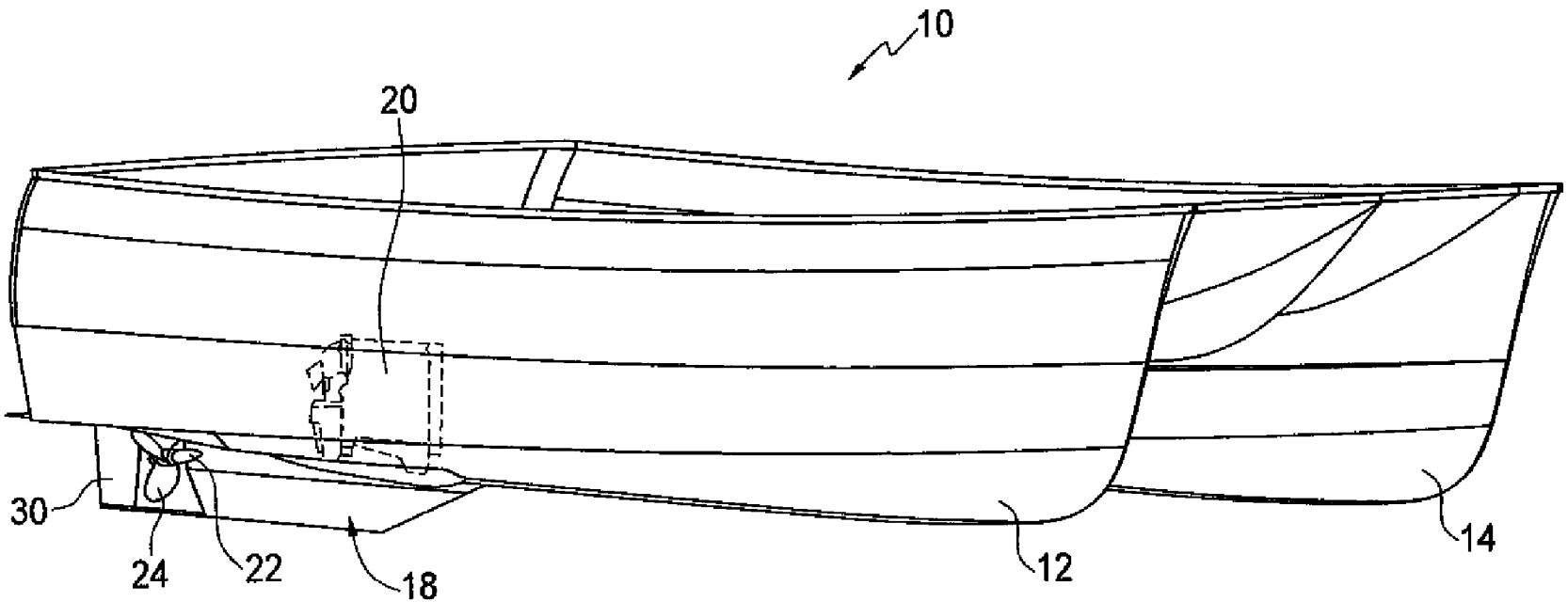
FIG. 1 is a perspective view of the catamaran hull disclosed herein.
Figure 2:
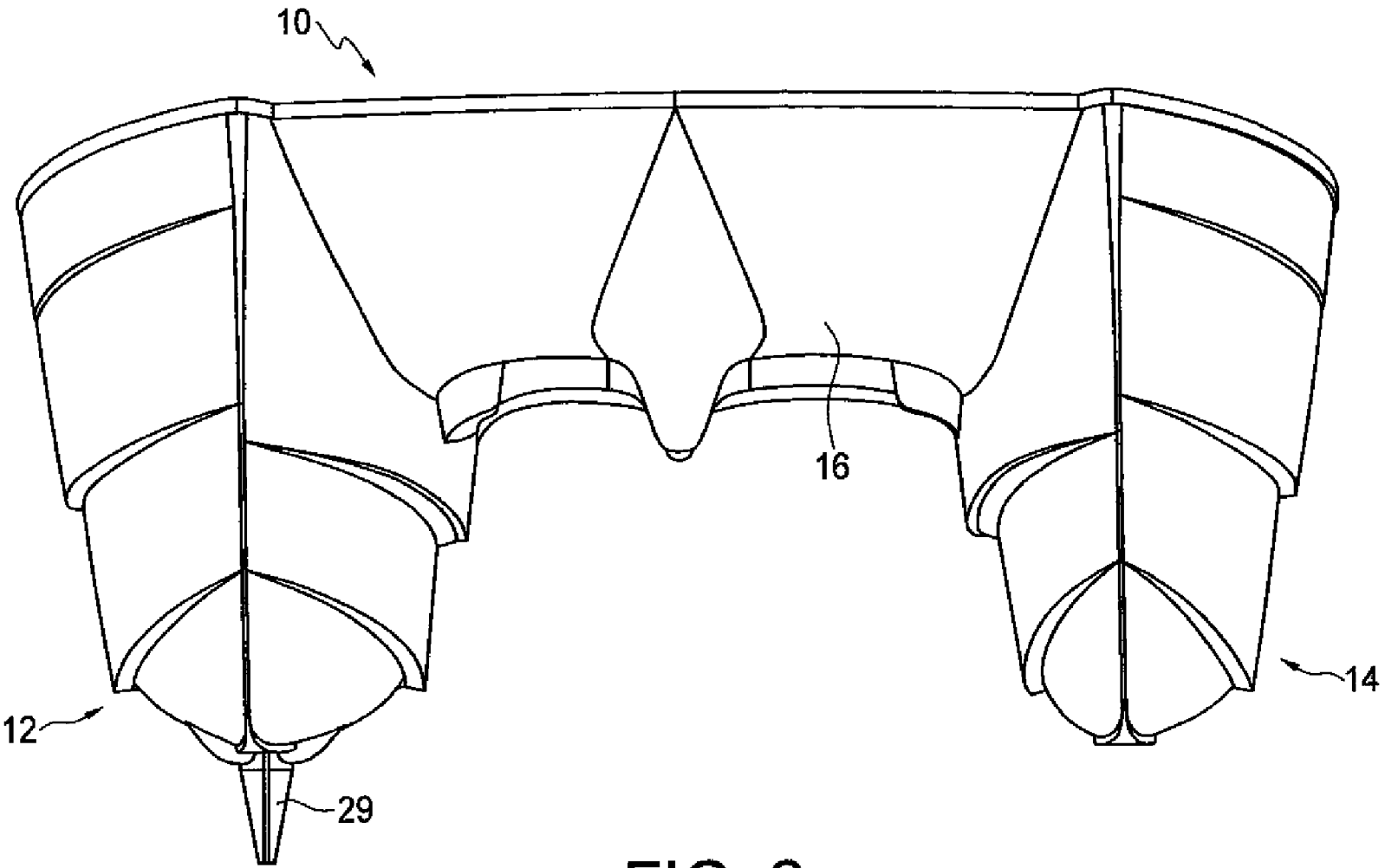
FIG. 2 is a view of the catamaran hull of FIG. 1 from the bow thereof.
Figure 3:
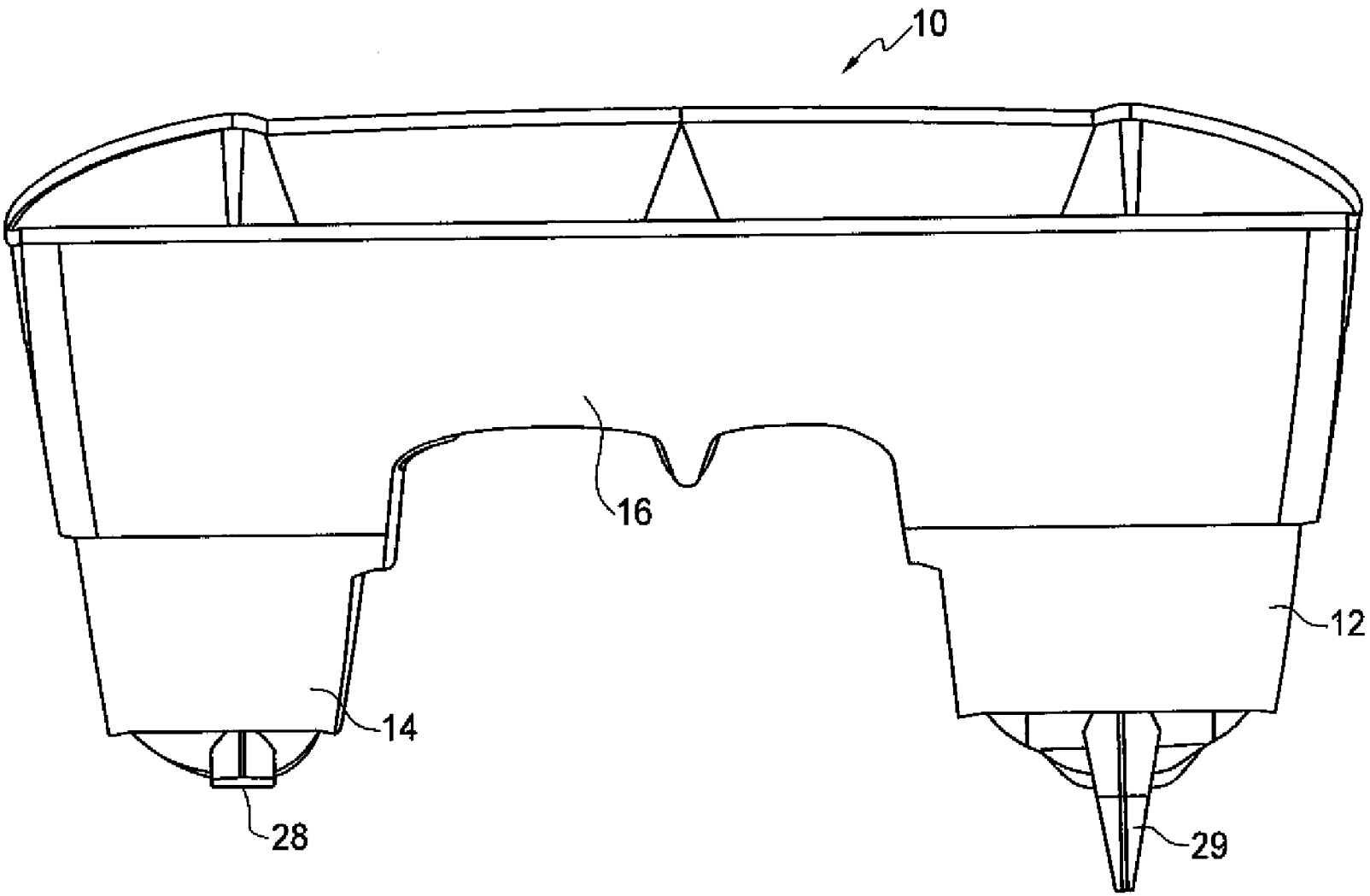
FIG. 3 is a view of the catamaran hull of FIGS. 1 and 2 from the stern thereof.
Figure 4:
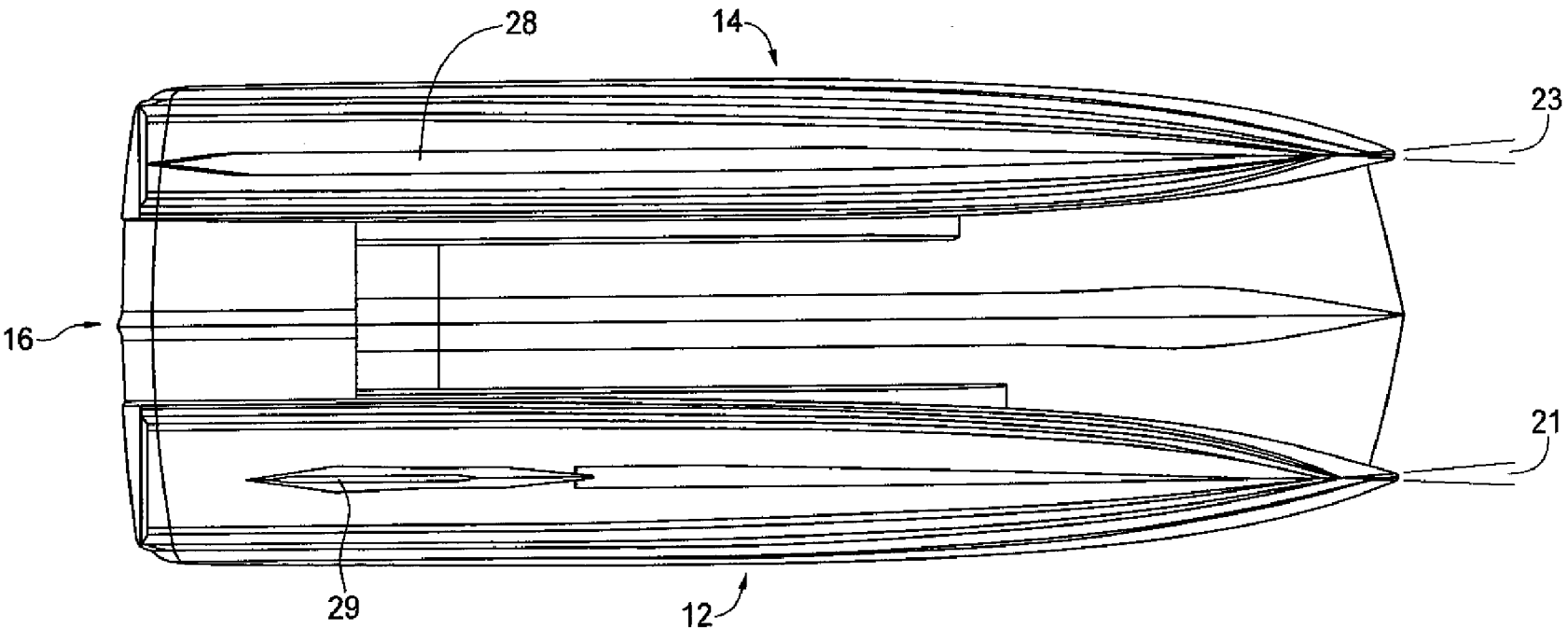
FIGS. 4 and 5 are top and bottom views, respectively, of the catamaran hull of FIGS. 1-3.
Figure 5:
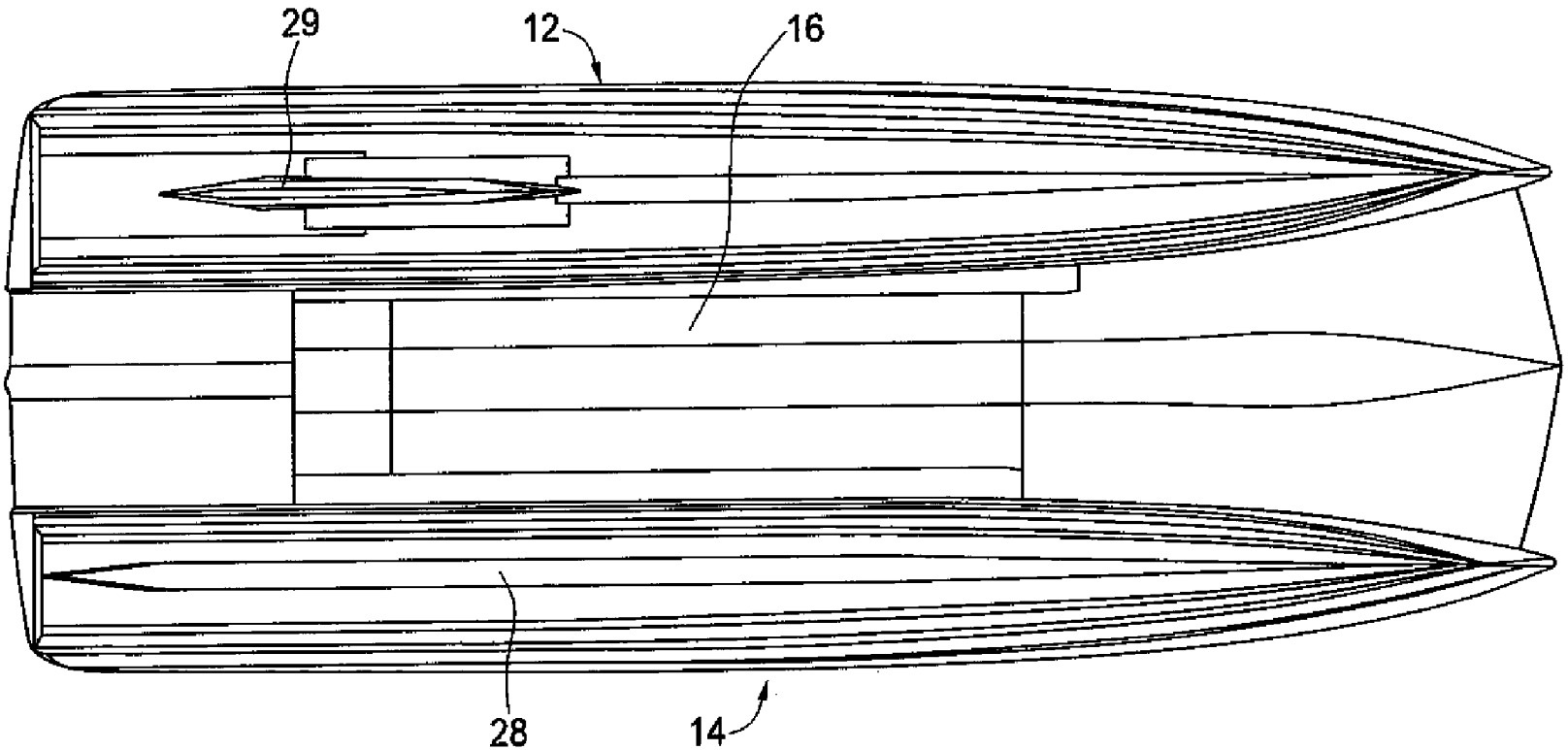

The complete catamaran hull, also referred to simply as a catamaran, disclosed herein, and is shown generally at 10, with two individual hulls 12 and 14 and an intermediate connecting portion 16. As shown in FIGS. 4 and 5, the hulls 12 and 14 are substantially the same length. The catamaran hull may be of various lengths, accommodating different numbers of people, depending upon the particular application and the specific design; for instance, a 39 foot catamaran will usually accommodate four adults.

In the present catamaran arrangement, only one of the hulls 12, 14 has a drive train 18, which comprises generally a motor, an output shaft and a propeller mounted on the output shaft. The single drive train 18 is mounted in the embodiment shown in the starboard hull, although the single drive train could alternatively be in the port hull.

With use of only one motor, located in one hull, that hull can be sized to accommodate the motor and the remainder of the drive train for easy access and service, while the non-propulsion hull can be narrow so as to reduce drag. The accommodations on the catamaran can be arranged to best advantage in the propulsion hull, which is wide.

Referring to FIG. 4, the outboard side hull entry angle for the starboard (propulsion) hull will vary from 8-15°, preferably approximately 10°, while the inboard side entry angle will range from 12-22°, preferably approximately 13°. This will yield a net outboard tow entry angle 21 of 2-5°. The starboard drive hull is asymmetric, off the boat centerline approximately 3' 10" toward the starboard side of the boat.

Also referring to FIG. 4, the outboard side hull entry angle for the port (non-propulsion) hull 14 will vary from 8-15°, preferably approximately 10°, while the inboard side entry angle will range from 7-17°, preferably approximately 9°. This will yield a net inboard tow entry angle 21 of 0-2°. The port hull is also asymmetric, off the boat centerline approximately 4' 10" toward the port side of the boat.

As indicated above, the starboard (propulsion) hull in the embodiment shown has a larger (wider) beam than the narrower port hull; typically, the starboard hull will have 20-35% more displacement than the non-propulsion hull. With respect to the drive train 18, motor 20 is typically conventional, for instance, a 380 HP Diesel. Other motors can be used. Shaft 22 and propeller 24 are also conventional.

The result of the differences in hull configuration produces a net turning force in the direction of the propulsion, e.g. starboard, hull. The hulls, each being asymmetrical but different in configuration, have their individual bows shaped so that in total, an overall push to starboard results, instead of being mirror images of each other, which would have no net effect. The asymmetrical hull shapes are accomplished by varying the inboard and outboard entry angle. The arrangement of the hulls, with the resulting tendency to push the direction of the catamaran to starboard during operation, offsets the propulsion action of the single propulsion hull, which tends to push the catamaran toward the port direction. These two forces (propulsion and net hull action) counteract each other, so that the boat as a result tends to run straight. This resulting balance allows for straight tracking and a balanced helm in virtually all sea conditions, significantly increasing the efficiency of the boat. The large beam of the propulsion hull allows additional accommodation space. For instance, a 39 ft. boat will include a large cockpit and salon area, as well as a galley, dining area, two staterooms with showers and two heads.

A single small keel fin 28 is located near the center of the narrow port (non-propulsion) hull, extending for substantially the length of the hull, while the starboard (propulsion) hull has a small keel fin 29 which extends for only a portion of the hull, because of the propulsion equipment. If the propulsion hull is the port hull, then the keel fin arrangements will be switched. An oversized rudder 30 can be used to control balance of the helm and tracking of the boat. The rudder may also have a balancing trim-tab which is arranged for neutral helm turning.

Since the hull carrying the propulsion equipment is larger, it displaces more water than the non-propulsion hull. This imbalance in displacement is compensated for by careful placement of the equipment and the accommodations in the catamaran. Weight imbalance results in unequal boat motion, with pitch and roll being a function of the mass and shape of the two hull(s). In the present arrangement, since one hull has more mass than the other, the pitch and roll characteristics of the two hulls are different from each other. Generally, narrow hulls with a greater dead rise have less resistance to submersion of the hull than wider hulls with a lower dead rise. To create a balanced side-to-side rolling sensation, given the weight and shape imbalances between the two hulls, asymmetric shapes are used for both hulls. The narrower hull, i.e. the non-powered hull, has less resistance to pitch and roll. This is partially offset by that hull carrying less weight and by using larger chines, which increases hull volume near and above the water line. In calmer water, the narrow hull operates with lower resistance due to its narrow shape, while in rough waters, it submerges and gains volume more rapidly on a proportional basis than the wider hull. The larger chines and hull volume at the bow of the non-propulsion hull are balanced to match the characteristics of the propulsion hull.

Accordingly, a catamaran has been described which uses a drive train in only one of its two hulls. The resulting thrust in one direction is offset by differences in configuration between the two hulls, both of which are asymmetric, but instead of being mirror images of each other, as with traditional catamarans, are differently configured so as to produce a movement or thrust of the boat in the other direction, with the thrust and the hull arrangement basically compensating for each other so as to produce straight line tracking of the boat during running of the boat.

Although a preferred embodiment of the invention has been disclosed for purposes of illustration, it should be understood that various changes, modifications and substitutions may be incorporated in the embodiment without departing from the spirit of the invention which is defined by the claims which follow.

The invention claimed is:

1. A catamaran using a motor and propeller for propulsion, comprising:

a pair of substantially parallel separate hulls, one hull being a starboard hull, the other hull being a port hull, the separate hulls having substantially the same length, connected by an intermediate catamaran hull portion, wherein each separate hull has a shape which is asymmetric; and a propulsion system which includes a motor and propeller for driving the catamaran hull, positioned in only one of the separate hulls, defining a propulsion hull, wherein thrust created by action of the propulsion system pushes the catamaran in a port direction if the propulsion system is located in the starboard hull and vice versa, wherein the two separate hulls have different asymmetric shapes which produces a net turning force in a starboard direction if the propulsion system is in the starboard hull and vice versa, counteracting the thrust created by action of the propulsion system in the one separate hull to produce straightline tracking of the beat catamaran during running of the catamaran.

2. The catamaran hull of claim 1, wherein the propulsion hull has a larger beam than the other, non-propulsion hull.

3. The catamaran hull of claim 2, wherein the propulsion hull has more displacement, in the range of 20-35%, than the other hull.

4. The catamaran hull of claim 1, wherein the propulsion hull has a net outboard tow entry angle in the range of 2-5° , and wherein the other hull has a net inboard tow entry angle in the range of 0-2° .

5. The catamaran hull of claim 1, including a single keel fin extending along a portion of the center line of the non-propulsion hull.

6. The catamaran hull of claim 1, wherein the propulsion assembly is located in the starboard hull.

7. The catamaran hull of claim 1, wherein the propulsion hull has an outboard side hull entry angle in the range of 8-15° and an inboard side hull entry angle in the range of 12-22° .

8. The catamaran hull of claim 1, wherein the non-propulsion hull has an outboard side hull entry angle in the range of 8-15° and an inboard side hull entry angle in the range of 7-17° .

9. The catamaran hull of claim 1, wherein the separate hulls are each asymmetric, wherein the starboard hull is asymmetric, off the boat centerline approximately 3'10" toward the starboard side of the boat and wherein the port hull is asymmetric, off the boat centerline approximately 4'10" toward the port side of the boat.

* * * * *

UNITED STATES PATENT AND TRADEMARK OFFICE

CERTIFICATE OF CORRECTION

PATENT NO. : 8,109,221 B2
APPLICATION NO. : 12/195093
DATED : February 7, 2012
INVENTOR(S) : Lawrence J. Graf and David J. Pugh It is certified that error appears in the above-identified patent and that said Letters Patent is hereby corrected as shown below:

Col. 4, Claim 1, line 5, delete “hull”

Col. 4, Claim 1, line 15, delete “beat”

Col. 4, Claims 2-9, lines 17 and 38, delete “hull”

Signed and Sealed this
Twenty-second Day of May, 2012

David J. Kappos

David J. Kappos
*Director of the United States Patent and Trademark Office*